US008726912B2

(12) United States Patent
Kimura

(10) Patent No.: US 8,726,912 B2
(45) Date of Patent: May 20, 2014

(54) HEAD ORNAMENT FASTENING MEMBER AND HEAD ORNAMENT

(75) Inventor: Harumi Kimura, Niigata (JP)

(73) Assignee: Aderans Co., Ltd., Tokyo (JP)

( * ) Notice: Subject to any disclaimer, the term of this patent is extended or adjusted under 35 U.S.C. 154(b) by 0 days.

(21) Appl. No.: 13/499,060

(22) PCT Filed: Jul. 27, 2010

(86) PCT No.: PCT/JP2010/062615
§ 371 (c)(1),
(2), (4) Date: Apr. 12, 2012

(87) PCT Pub. No.: WO2011/040113
PCT Pub. Date: Apr. 7, 2011

(65) Prior Publication Data

US 2012/0186595 A1 Jul. 26, 2012

(30) Foreign Application Priority Data

Sep. 30, 2009 (JP) ..... 2009-229075

(51) Int. Cl.

| | |
|---|---|
| ***A41G 3/00*** | (2006.01) |
| ***A41G 5/00*** | (2006.01) |
| ***A45D 24/28*** | (2006.01) |
| ***A45D 24/00*** | (2006.01) |
| ***A45D 24/10*** | (2006.01) |
| ***A45D 8/12*** | (2006.01) |

(52) U.S. Cl.
CPC ..... *A41G 3/0033* (2013.01); *A45D 8/12* (2013.01)
USPC ..... 132/53; 132/144; 132/148

(58) Field of Classification Search
CPC ..... A41G 3/00; A41G 3/0008; A41G 3/0033; A41G 3/0025; A41G 5/0053; A41G 5/0073; A45D 2/42; A45D 2/44; A45D 8/12; A45D 8/22; A45D 8/28; A45D 8/30; A45D 24/10; A45D 24/38
USPC ..... 132/53–56, 212, 219, 273, 141, 142, 132/144, 148, 201, 105, 106, 107, 126, 275, 132/276, 280–284, 137, 138, 152, 159–161, 132/901, 278; 446/394; D28/39–43, 74, 75, D28/92, 93; 24/593.11, 598.5
See application file for complete search history.

(56) References Cited

U.S. PATENT DOCUMENTS 171,717 A * 1/1876 Britton ..... 132/144
513,579 A * 1/1894 Kinzly ..... 132/53

(Continued)

FOREIGN PATENT DOCUMENTS

FR 665128 A 9/1929
JP 42-15656 B1 8/1967

(Continued)

OTHER PUBLICATIONS

English translation of Written Opinion (PCT/ISA/237) issued in PCT/JP2010/062615 mailed in Aug. 2010.

(Continued)

*Primary Examiner* — Vanitha Elgart
(74) *Attorney, Agent, or Firm* — Chen Yoshimura LLP

(57) ABSTRACT

A head ornament fastening member that attaches a head ornament to hairs on a head. The head ornament fastening member comprises a first fastening member that includes a base, and a plurality of stems which protrude from a surface of the base and are inserted into the hairs from upside; and a second fastening member that includes a plurality of comb-tooth-like portions which intersect the plurality of stems and are inserted into the hairs from a lateral direction. The plurality of stems of the first fastening member and the plurality of comb-tooth-like portions of the second fastening member intersect with each other in the hairs from upside and a lateral direction, thereby fastening the head ornament to the hairs.

20 Claims, 7 Drawing Sheets

(56) References Cited

U.S. PATENT DOCUMENTS

| | | | | | |
|---|---|---|---|---|---|
| 573,887 | A * | 12/1896 | Kraus | 132/133 |
| 672,159 | A * | 4/1901 | Bechtold | 132/144 |
| 1,276,828 | A * | 8/1918 | Tannler | 132/68.1 |
| 1,321,322 | A * | 11/1919 | Myers | 140/87 |
| 1,378,134 | A * | 5/1921 | Rhein et al. | 132/144 |
| 1,397,904 | A * | 11/1921 | Rhein et al. | 132/281 |
| 1,714,358 | A * | 5/1929 | Finkelstein | 132/105 |
| 1,775,209 | A * | 9/1930 | Oppenheim | 132/105 |
| 1,781,324 | A * | 11/1930 | Dies | 132/278 |
| 2,175,344 | A * | 10/1939 | Friedman | 132/137 |
| 2,329,361 | A * | 9/1943 | Solomon | 132/157 |
| 2,490,285 | A * | 12/1949 | Smith | 132/156 |
| 2,506,297 | A * | 5/1950 | Goodman | 132/157 |
| 2,559,940 | A * | 7/1951 | Cartheuser | 132/157 |
| 2,566,965 | A * | 9/1951 | Shaw | 132/155 |
| 2,844,154 | A * | 7/1958 | Solomon | 132/281 |
| 2,989,059 | A * | 6/1961 | Solomon | 132/159 |
| 3,144,028 | A * | 8/1964 | Sawyer | 132/284 |
| 3,145,718 | A * | 8/1964 | Pigo | 132/148 |
| 3,604,431 | A * | 9/1971 | Pearson et al. | 132/137 |
| 3,669,129 | A * | 6/1972 | Serebrin | 132/281 |
| 3,872,873 | A * | 3/1975 | Tupper | 132/159 |
| 4,103,693 | A * | 8/1978 | Reagan | 132/276 |
| 4,155,370 | A * | 5/1979 | Nemoto | 132/53 |
| 4,168,713 | A * | 9/1979 | Agiotis | 132/53 |
| 4,359,061 | A * | 11/1982 | Colclasure | 132/144 |
| D272,861 | S * | 2/1984 | Incando | D28/93 |
| 5,082,011 | A * | 1/1992 | Wu | 132/281 |
| 5,682,908 | A * | 11/1997 | Chou | 132/278 |
| 5,927,291 | A * | 7/1999 | Beall | 132/144 |
| 6,298,861 | B1 * | 10/2001 | Kageyama et al. | 132/53 |
| 7,735,495 | B2 * | 6/2010 | Lane et al. | 132/53 |
| 7,827,999 | B2 * | 11/2010 | Tu | 132/277 |
| 2002/0056464 | A1 * | 5/2002 | Nakane et al. | 132/53 |
| 2003/0140934 | A1 * | 7/2003 | Sugai et al. | 132/53 |
| 2007/0157941 | A1 * | 7/2007 | Awad et al. | 132/53 |
| 2008/0110472 | A1 * | 5/2008 | Kaweblum | 132/276 |
| 2009/0071490 | A1 * | 3/2009 | Sthair | 132/105 |
| 2009/0188512 | A1 * | 7/2009 | Eaton | 132/54 |
| 2010/0139679 | A1 * | 6/2010 | Umezu et al. | 132/106 |
| 2010/0170524 | A1 | 7/2010 | Kimura | |
| 2013/0042881 | A1 * | 2/2013 | Mutchler | 132/201 |

FOREIGN PATENT DOCUMENTS

| | | | |
|---|---|---|---|
| JP | 1978-99287 | U | 8/1978 |
| JP | S56-23294 | Y2 | 6/1981 |
| JP | 3041979 | U | 10/1997 |
| JP | 2001-218616 | A | 8/2001 |
| JP | 3134280 | U | 8/2007 |
| JP | 2008-50729 | A | 3/2008 |
| WO | 2008/146623 | A1 | 12/2008 |

OTHER PUBLICATIONS

International Search Report (ISR) issued in PCT/JP2010/062615 mailed in Aug. 2010.

Written Opinion (PCT/ISA/237) issued in PCT/JP2010/062615 mailed in Aug. 2010. (Concise Explanation of Relevance: This Written Opinion considers that the some of claims are not described by or obvious over the reference Foreign Patent document Nos. 4-6 cited in ISR above.).

* cited by examiner (a)

(b)

HEAD ORNAMENT FASTENING MEMBER AND HEAD ORNAMENT

TECHNICAL FIELD

The present invention relates to a head ornament fastening member that attaches a head ornament such as a wig or a hair increasing tool to hairs on a head, and a head ornament that includes the head ornament fastening member.

BACKGROUND ART

There are various known fastening members configured to attach a head ornament such as a wig or a hair increasing tool, via hairs remaining on a head. For example, Patent Document 1 below describes a stopper in which plural protrusion pieces are attached to one leg piece of a metallic reversible member so as to have a comb shape, and a friction member is attached to the other leg piece. The stopper is configured to be opened and closed by reversing and restoring the reversible member. In order to attach the head ornament to the hairs using the stopper, the reversible member of the stopper is first reversed to be released while the stopper is attached to the rear surface of the head ornament. Subsequently, the stopper is placed on the head, and a user restores the reversible member by pressing the reversible member with his hand, so that the head ornament is attached to the hair.

Patent Document 2 below discloses a wig attachment tool which includes a male component of a so-called hook-and-loop fastener, with a configuration in which plural monofilaments protrude from one surface of a base sheet. In order to attach the wig to the hairs using the wig attachment tool, the hairs are tangled with the monofilaments by pressing the front surface of the wig toward the head, while the wig attachment tool is attached to the rear surface of the wig. Thus, the wig is attached to the hairs.

Patent Document 3 below describes an attachment tool which includes a so-called spring comb with plural comb-tooth-like portions, which are formed by bending an elongated member at the front end of the comb. In order to attach the wig to the hairs using the attachment tool, the hairs are clamped by the comb-tooth-like portions by inserting the comb-tooth-like portions into the hairs on the head, while an ornament tool is attached to the rear surface of the wig. Thus, the wig is attached to the hairs.

RELATED ART DOCUMENTS

Patent Documents

Patent Document 1: Japanese Examined Utility Model Application Publication No. S56-23294

Patent Document 2: Japanese Registered Utility Model No. 3134280

Patent Document 3: Japanese Patent Application Laid-Open No. 2008-50729

SUMMARY OF THE INVENTION

Problems to be Solved by the Invention

However, with respect to the stopper described in Patent Document 1, there is a need to increase the reversing force of the reversible member in order to obtain a sufficient fixing force to use the stopper. The user must clamp or release the hairs by pressing the reversible member with his/her fingers. For this reason, when the required force for reversing the stopper is set to be, for example 0.7 to 1.0 Kg or more, a person with hand injury or other hand problems or weakness, or a weak or older person may not successfully reverse the stopper, which means the wig would not be easily attached and detached. On the other hand, when the required force for reversing the stopper is set to be small in order to easily reverse the reversible member, a sufficient fixing force by the stopper may not be obtained. Thus, there is a problem in that the fixing force of the stopper is incompatible with the easiness of attaching and detaching the wig.

When wearing a wig with such a stopper, the portion where the stopper is fixed is rolled up to be positioned before attaching the wig. For example, when a wig with the stopper on the circumferential edge is attached to a head, there is a need to roll up the circumferential edge of the wig in order to deeply insert the comb-tooth-like portions of the stopper into the hairs. For this reason, there is another problem in that the repeated attachment/detachment operations cause a fatigue in a portion of the wig base where the stopper is fixed, and the durability of the wig is thus easily lowered.

In the attachment tool of Patent Document 2 above, the monofilaments may be easily tangled with the hairs simply by slightly pressing down the surface of the wig after the wig is mounted on a head, so attaching and detaching the wig is satisfactorily easy. However, the fixing force by the attachment tool is not sufficient. If plural attachment tools are provided on the head ornament in order to obtain a strong fixing force, the total number of the monofilaments as a male component of the hook-and-loop fastener increases with the number of the attachment tools. For this reason, this attachment tool has other problems in that the number of the monofilaments which do not contribute to fixing the hairs increases, and the hairs on the head or the wig can become easily tangled with those monofilaments. As a result, the handling of the attachment tool becomes troublesome.

In the attachment tool such as a spring comb described in Patent Document 3 above, because the wig is attached to a head in a manner so that the wig is put on the head and the comb-tooth-like portions are inserted into the hairs, a special force is not needed and thus attaching/detaching the wig is comparatively satisfactorily easy. However, although the attachment tool has a high fixing force in the width direction, the fixing force by the comb-tooth-like portions in the longitudinal direction or the vertical direction is low.

Since the spring comb is intended to hold the hairs themselves, when the spring comb is used to attach a head ornament such as a wig or a hair increasing tool, it is difficult to obtain the required fixing force for the fastening member of the head ornament.

Therefore, the present invention is directed to a head ornament fastening member that substantially obviates one or more of the problems due to the limitations and disadvantages of the prior art. The first objective of the present invention is to provide a head ornament fastening member, which can provide a sufficient fixing force to hairs, and can make the attaching and detaching operations easy. Further, the second objective of the invention is to provide a head ornament, which can provide a sufficient fixing force to hairs, and can make the attaching and detaching operations easy. Additional features and advantages of the invention will be set forth in the descriptions that follow and in part, will be apparent from the description, or may be learned by practice of the invention. The objectives and other advantages of the invention will be realized and attained by the structure particularly pointed out in the written description and claims thereof, as well as in the appended drawings.

Means for Solving the Problems

In order to achieve the first objective, a head ornament fastening member according to an embodiment of the present invention comprises: a first fastening means that includes a base, and a plurality of stems which protrude from a surface of the base and are inserted into the hairs from upside; and a second fastening means that includes a plurality of comb-tooth-like portions which intersect the plurality of stems and are inserted into the hairs from a lateral direction, wherein the plurality of stems of the first fastening means and the plurality of comb-tooth-like portions of the second fastening means intersect with each other while being inserted into the hairs so as to be fastened to the hairs, thereby fastening the head ornament to the hairs.

With respect to the head ornament fastening member, the first fastening means includes the plural stems which protrude from one surface of the base and are inserted into the hairs from upside. Thanks to this, fastening force by the first fastening means may be obtained by tangling or engaging the hairs with the plural stems. Further, the second fastening means includes the plural comb-tooth-like portions which intersect the plural stems and are inserted into the hairs in a lateral direction. Thanks to this, fastening force by the second fastening means may be obtained in a manner such that the hairs are clamped between the comb-tooth-like portions, and are tangled with the comb-tooth-like portions.

The head ornament is attached to the hairs by inserting the plural stems and the plural comb-tooth-like portions into the hairs so as to intersect with each other. Thanks to this, for example, one stem of the first fastening means and one comb-tooth-like portion of the second fastening means are engaged with the same hairs while intersecting to each other, enhancing the fastening forces by the respective fastening members. Further, the stems of the first fastening means and the comb-tooth-like portions of the second fastening means limit the relative movement of the other. Thus, the fastening forces by the first fastening means and the second fastening means may be improved, and it is possible to obtain a sufficient fixing force of the head ornament fastening member to the hairs.

In addition, the head ornament fastening member may be easily attached to the hairs in such a manner that the stems of the first fastening means are inserted into the hairs from upside, and the comb-tooth-like portions of the second fastening means are inserted into the hairs in a lateral direction. The head ornament fastening member may be easily detached by releasing the fastening state between the first fastening means and the second fastening means. Thus, the attaching and detaching operations are easily performed.

In one embodiment of the present invention, the second fastening means is preferably connected to the base of the first fastening means so as to be slidable in the lateral direction, and hence the plurality of comb-tooth-like portions are slid and inserted into the hairs. With this construction, when fastening the head ornament fastening member, the plural comb-tooth-like portions of the second fastening means may be inserted into while the movement of the hairs is limited by the plural stems of the first fastening means. Thus, sufficient fastening force is obtained.

In another embodiment of the present invention, the second fastening means is preferably connected to the base of the first fastening means so as to be inclinable, and hence the plurality of comb-tooth-like portions can be inserted into the hairs while being inclined. With this construction, when the plural comb-tooth-like portions of the second fastening means are slid into after the plural stems of the first fastening means are tangled with the hairs, the inclination angle of the plural comb-tooth-like portions can be adjusted. Thanks to this, the comb-tooth-like portions of the second fastening means may be inserted into the desirable position between the hairs, so that the attachment is easily performed.

In another embodiment of the present invention, the stems are preferably formed of an elastic material, such that when the plurality of comb-tooth-like portions are slid, the stems are elastically deformed and inserted into the hairs. The rigidity of the stems preferably ranges 1.5 to 4.0 times that of the hairs. With this construction, since the stems may be elastically deformed when the plural comb-tooth-like portions are slid, the plural comb-tooth-like portions may be inserted at a closer position to the base of the first fastening means, so that the plural stems and the plural comb-tooth-like portions may easily intersect with each other.

In an embodiment of the present invention, each of the stems preferably includes an elongated material protruding from the base of the first fastening means, and a swollen portion swollen laterally from an axis of the elongated material, the swollen portion being able to be engaged with the hairs. With this construction, the respective stems and the hairs may be easily tangled with each other, so that the fastening force may be easily improved.

In another embodiment of the present invention, the plurality of stems of the first fastening means are preferably formed to have irregular lengths. With this construction, when the plural stems are inserted into the hairs, the depths of the respective stems may be irregular, and hence the respective stems may be easily tangled with the hairs, thereby easily improving the fastening force.

In a further embodiment of the present invention, the lengths of the stems preferably range 3-6 mm. The density of the stems preferably ranges 50-120 stems/cm$^2$. With this construction, the hairs may be easily tangled with the stems, so that the fastening force may be easily improved.

In yet another embodiment of the present invention, the comb-tooth-like portions are preferably formed of an elastic material having a rigidity higher than that of the stems. With this construction, when sliding the second fastening means, the respective comb-tooth-like portions may be easily inserted between the plural stems or the hairs, so that the attachment may be easily performed.

In an embodiment of the present invention, the comb-tooth-like portion preferably includes a longitudinal opening inside the comb-tooth-like portion, and hence the comb-tooth-like portion is deformed with the deformation of the longitudinal opening. With this construction, when sliding the second fastening means, the respective comb-tooth-like portions are easily deformed, so that the respective comb-tooth-like portions may be easily inserted into where the stems and the hairs are tangled with each other.

In the second fastening means of a preferred embodiment of the present invention, spaces between the adjacent comb-tooth-like portions are preferably wider at the front end, and are narrower at the rear end. With this construction, the force clamping the hairs between the adjacent comb-tooth-like portions may increase as sliding the second fastening means, so that the fastening force may be improved.

In the second fastening means, the plurality of comb-tooth-like portions are preferably formed by repeatedly folding one wire material in a plane, such that the adjacent comb-tooth-like portions are continuous to each other through a circular-arc loop portion, and the diameter of the circular-arc loop portion is larger than the space between the adjacent comb-tooth-like portions.

With this construction, thanks to the biasing force by the loop portion, when the hairs are clamped between the adjacent comb-tooth-like portions, they would prevent the wire material from being deformed and making the space between the adjacent comb-tooth-like portions wider. Thus, the clamping force between the respective comb-tooth-like portions may be improved.

In the second fastening means of the present invention, it is preferable that the comb-tooth-like portions are loosely engaged with annular connection portions fixed to the base, so that the second fastening means is slidably connected to the base. With this construction, the second fastening means may be slidably connected to the base of the first fastening means with a simple construction.

In this construction, it is preferable that the comb-tooth-like portions of the second fastening means disposed at outer sides in a width direction are, respectively at one position, engaged with the annular connection portion. With this construction, the sliding resistance can be small against the second fastening means sliding relatively to the base of the first fastening means. Thus, the operability may be easily improved.

In an embodiment of the present invention, the base of the first fastening means is preferably formed of a flexible material, and is deformable with the deformation of the head ornament. With this construction, it is possible to prevent interfering with the deformation of the head ornament.

In order to achieve the second object, a head ornament of the present invention comprises: a first fastening means that includes a base fixed to the head ornament body, and a plurality of stems protruding from a surface of the base and are inserted into the hairs from upside; and a second fastening means that includes a plurality of comb-tooth-like portions which intersect the plurality of stems and are inserted into the hairs from lateral direction, wherein the plurality of stems of the first fastening means and the plurality of comb-tooth-like portions of the second fastening means intersect with each other while being inserted into the hairs so as to be fastened to the hairs, thereby fastening the head ornament to the hairs.

With respect to the head ornament, the first fastening means includes the base which is fixed to the head ornament body, and the plural stems which protrude from one surface of the base and are inserted into the hairs from upside. Thanks to this, fastening force by the first fastening means may be obtained by tangling the plural stems with the hairs. Further, the second fastening means includes the plural comb-tooth-like portions which intersect the plural stems and are inserted into the hairs from a lateral direction. Thanks to this, fastening force may be obtained by clamping and tangling the hairs between the comb-tooth-like portions.

With respect to the fastening member of an embodiment of the present invention, the plural stems and the plural comb-tooth-like portions are inserted into the hairs so as to intersect with each other, and thus fixed to the hairs. Thus, for example, one stem of the first fastening means and one comb-tooth-like portion of the second fastening means are engaged with the same hair while intersecting to each other, improving the fastening force. Further, the stems of the first fastening means and the comb-tooth-like portions of the second fastening means may limit the relative movement of the other. Thanks to this, the fastening forces by the first fastening means and the second fastening means may be improved, and thus a sufficient fixing force of the head ornament to the hairs can be obtained.

In addition, when attaching the head ornament to the hairs, the stems of the first fastening means are inserted into the hairs from the upside, and the comb-tooth-like portions of the second fastening means are inserted into the hairs in a lateral direction. In this way the head ornament may be easily attached to the head. On the other hand, the head ornament may be easily detached by releasing the fastening state. Thus, the head ornament attaching and detaching operations may be easily performed.

In an embodiment of the present invention, the first fastening means and the second fastening means are preferably arranged at a plurality of separate positions at a circumferential edge of the head ornament body. Since a sufficient fixing force may be obtained by the first fastening means and the second fastening means, the area where the first fastening means and the second fastening means are arranged can be small. Thanks to this, it is possible to prevent hairs from becoming unintentionally tangled with the first fastening means and the second fastening means when the head ornament is not in use or when attaching and detaching. Thus, the handling of the head ornament is easy.

In an embodiment of the present invention, the plurality of comb-tooth-like portions are preferably connected to the base of the first fastening means so as to be slidable inward from the circumferential edge of the head ornament body. With this construction, the head ornament may be attached to the hairs without largely rolling up the circumferential edge of the head ornament body. Thus, the head ornament attaching and detaching operations may be easily performed.

The second fastening means is connected to the first fastening means, preferably in such a manner that the rear ends of the plurality of comb-tooth-like portions in the sliding direction are slidable from a position outside of the circumferential edge to a position inside the circumferential edge of the head ornament body. With this construction, the head ornament may be easily attached to the head and an excellent appearance can be achieved, because the plural comb-tooth-like portions are not visible from the outside after the head ornament is attached to the head.

Effects of the Invention

According to the head ornament fastening member of an embodiment of the present invention, the head ornament fastening member comprising: a first fastening means that includes a base, and a plurality of stems which protrude from a surface of the base and are inserted into the hairs from upside; and a second fastening means that includes a plurality of comb-tooth-like portions which intersect the plurality of stems and are inserted into the hairs from a lateral direction. The plurality of stems of the first fastening means and the plurality of comb-tooth-like portions of the second fastening means intersect to each other while being inserted into the hairs so as to be fastened to the hairs, thereby fastening the head ornament to the hairs. Thanks to this, a head ornament fastening member capable of obtaining a sufficient fixing force to hairs and facilitating the attaching and detaching operations can be provided.

With respect to a head ornament of the present invention, the head ornament comprising: a first fastening means that includes a base fixed to the head ornament body, and a plurality of stems protruding from a surface of the base and are inserted into the hairs from upside; and a second fastening means that includes a plurality of comb-tooth-like portions. The plurality of stems of the first fastening means and the plurality of comb-tooth-like portions of the second fastening means intersect to each other while being inserted into the hairs so as to be fastened to the hairs, thereby fastening the head ornament to the hairs. Thanks to this, a head ornament capable of obtaining a sufficient fixing force to hairs and facilitating the attaching and detaching operation can be provided. It is to be understood that both the foregoing general description and the following drawings and detailed description are exemplary and explanatory and are intended to provide further explanation of the invention as claimed.

DESCRIPTION OF REFERENCE CHARACTERS

10: HEAD ORNAMENT FASTENING MEMBER
11: BASE SHEET
12: FILAMENT PROTRUSION
13: MALE COMPONENT
14: COMB-TOOTH-LIKE PORTION
15: SPRING COMB
16: FILAMENT
17: SWOLLEN PORTION
18: CONNECTION EDGE
19: HAIR
20: HEAD ORNAMENT
21: BASE
22: HEAD ORNAMENT BODY
23: LOOP PORTION
24: CONNECTION PORTION
27: JOINT LAYER
28: SPACE
31: SHEET

DETAILED DESCRIPTION OF EMBODIMENTS

Hereinafter, embodiments of the present invention will be described, with reference to FIGS. 1 to 11.

Figure 1:
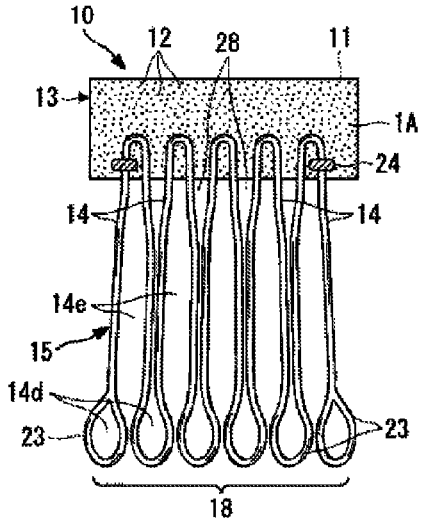
FIG. 1 is a plan view illustrating a head ornament fastening member according to an embodiment of the present invention.
Figure 2:
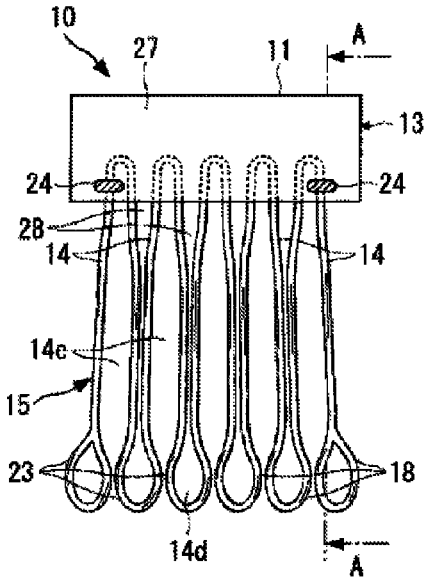
FIG. 2 is a bottom view illustrating the head ornament fastening member according to the embodiment of the present invention.
Figure 3:
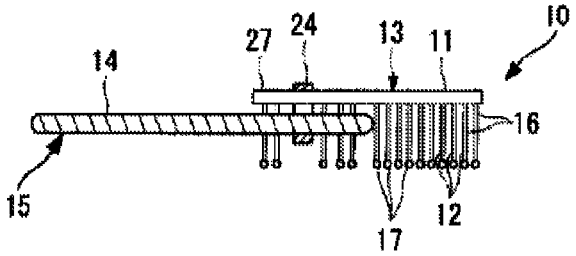
FIG. 3 is a cross-sectional view taken along the line A-A in FIG. 2.
Figure 9:
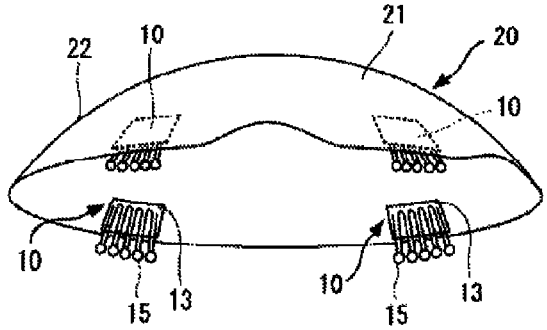
FIG. 9 is a schematic perspective view illustrating the head ornament according to an embodiment of the present invention.
Figure 10:
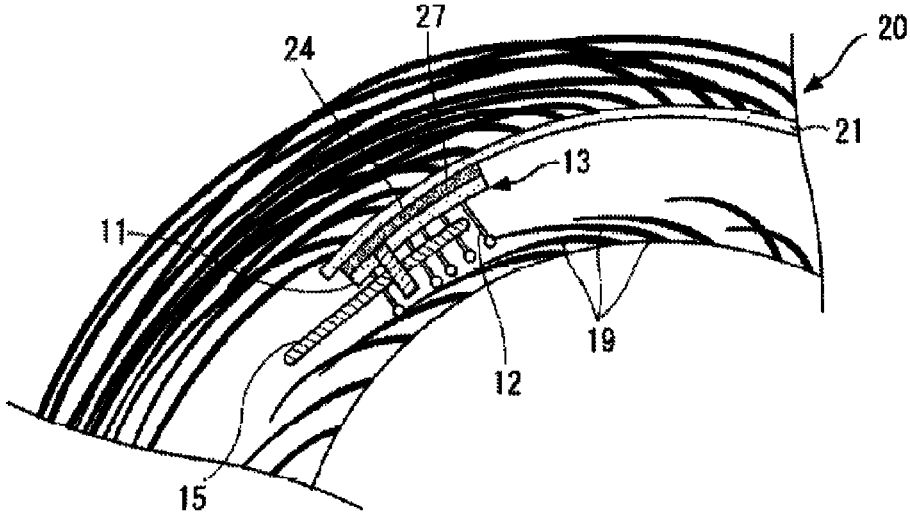
FIG. 10 is a partially cross-sectional view illustrating a halfway state wherein the head ornament fastening member according to the embodiment of the present invention is being attached to a head.

FIGS. 1 to 3 illustrate a head ornament fastening member 10 according to an embodiment, and FIGS. 9 and 10 illustrate head ornament 20 having the head ornament fastening member 10.

The head ornament 20 of the embodiment is, for example, a wig or a hair increasing tool. The head ornament 20 includes a head ornament body 22 in which multiple hairs are implanted in various bases 21, and fastening members 10 are attached to the rear surface of the base 21 of the head ornament body 22. In FIG. 9, natural or artificial hairs are attached to the base 21, but are not specifically illustrated.

As illustrated in FIGS. 1 to 3, the fastening member 10 of the embodiment has a construction, in which a male component 13 of a hook-and-loop fastener (hereinafter, referred to as a male component) serving as a first fastening means is connected to a spring comb 15 serving as a second fastening means.

The male component 13 includes a base sheet 11 which is attachable to the base 21, and filament protrusions 12 serving as plural stems, which are protruding from one surface of the base sheet 11 and to be inserted into the hairs 19 so as to be fastened to the hairs 19.

The base sheet 11 is formed of a flexible material such as resin, which is deformable according to the shape of the base 21 of the head ornament body 22 and the head surface. It is desirable that the base sheet 11 is formed softer than the base 21 of the head ornament body 22, because the deformation of the head ornament body 22 is not prevented. In the base sheet 11, the surface not having the filament protrusions 12 is to be attached to the head ornament body 22. Note that, other thin members such as a film and a plate may be also used as the base sheet 11.

The plural filament protrusions 12 are uprightly formed on one surface of the base sheet 11. Each of the filament protrusions 12 protrudes in the longitudinal direction from the base sheet 11 toward a surface of a scalp. The longitudinal direction may be a direction, which is directed from one surface of the base sheet 11 toward the head, and may not be necessarily perpendicular to the base sheet 11. Each of the filament protrusions 12 may be formed linear, curved, or bent, provided that at least a part of the filament protrusion 12 is directed from the surface of the base sheet 11 toward the head.

The filament protrusion 12 of the embodiment is formed of an elongated material which is elastically deformable due to the flexibility thereof, for example, resin such as polypropylene. The surface of the filament protrusion 12 may be provided with a coating of styrene elastomer in order to increase the friction coefficient thereof.

The filament protrusion 12 includes a filament 16 which protrudes and extends from the base sheet 11 and a swollen portion 17 which is swollen laterally from the axis of the filament 16.

The swollen portion 17 can be at the free end of each filament 16, or can be at the middle portion of the filament 16. It is desirable that the swollen portion 17 is at the free end, because the hairs 19 are easily tangled with the filament protrusion 12 when the filament protrusion 12 is inserted into the hairs 19, and the tangled hairs are not easily separated from the filament protrusion 12. For example, the swollen portion 17 can be formed in a spherical shape which protrudes from the entire circumference of the filament 16, or can be formed in a shape in which the filament 16 is bent or curved so as to protrude toward one side.

Figure 4:
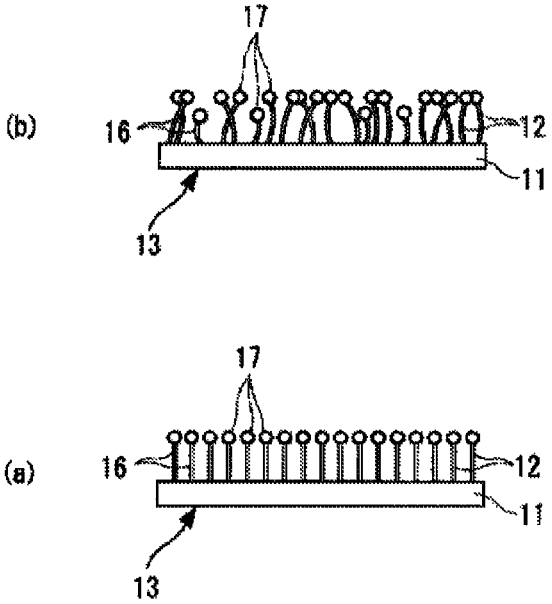
FIG. 4(*a*) is a cross-sectional view illustrating a male component of a hook-and-loop fastener according to the embodiment, and FIG. 4(*b*) is a cross-sectional view illustrating a male component of a hook-and-loop fastener according to another embodiment.

The respective filaments 16 can be regularly arranged with the same length so as to be parallel to each other as illustrated in FIG. 4(*a*), or can be irregularly arranged with different lengths in different directions as illustrated in FIG. 4(*b*). When the respective filaments 16 are arranged with different lengths and different directions, or some of the filaments 16 are tangled with each other, the hairs 19 may be easily tangled with the filaments, thereby obtaining a stable fastening force. When the lengths of the plural filament protrusions 12 are irregular, the positions where the hairs 19 are tangled with the filament protrusions 12 may be different from each other.

It is particularly desirable that the length of the filament protrusion 12 is 3 to 6 mm. When the lengths of the filament protrusions 12 are too short, the filament protrusions are not easily tangled with the hairs 19. On the other hand, when the filament protrusions 12 are too long, the base sheet 11 easily rises from the head surface or the filament protrusions 12 are excessively deformed when the head ornament is attached, and thus the filament protrusions cannot be easily tangled with the hairs 19.

The thickness of the filament 16 may be in a range which could give the necessary elasticity or strength, and for example, the diameter of the filament 16 may be 1.2 to 6.0 times the diameter of the hair 19. It is desirable that the rigidity, which is exhibited by the deflection load, of the plural filaments 16 protruding from the base sheet 11 is 1.5 to 4.0 times that of the hair 19. When the filaments 16 are too soft, the filaments may not be easily inserted into the hairs 19 when being attached thereto, and therefore the filaments 16 are not easily tangled with the hairs 19. On the other hand, when the filaments 16 are too hard, the filaments are not easily tangled with the hairs 19 or the filaments 16 may be easily untangled, and therefore the fastening force may be reduced.

It is desirable that the arrangement density of the filament protrusions 12 is 50 to 120 filaments/$cm^2$. When the arrangement density is low, the hairs are not easily tangled with the filament protrusion 12, and the desired fastening force of the fastening member 10 may not be ensured. On the other hand, when the arrangement density is too high, the space between the respective filament protrusions 12 is narrowed, and therefore the hairs 19 are not easily tangled with the fastening member, although the fastening force between the fastening member 10 and the hairs 19 may be more easily ensured as the arrangement density becomes higher.

The spring comb 15 of the fastening member 10 according to the embodiment includes plural comb-tooth-like portions 14 which extend in a lateral direction so as to intersect the filament protrusions 12, and a connection edge 18 which connects the respective comb-tooth-like portions 14 at the rear end. The extension directions of the respective comb-tooth-like portions 14 may be different from each other, or otherwise the extension directions from the connection edges 18 may be the same to each other, such that they are substantially parallel to each other. When the extension directions of the respective comb-tooth-like portions 14 are almost same to each other, the spring comb 15 may be easily slid as described below.

Metal, synthetic resin, ceramic, and the like may be exemplified as the material which forms the spring comb 15. The spring comb 15 may be formed by various methods such as wire bending, strip material pressing, and molding.

Each of the comb-tooth-like portions 14 is formed of an elastic material such as metal or synthetic resin, so that it is appropriately elastically deformable in the width direction. When the comb-tooth-like portion is elastically deformable in the width direction, the hairs 19 may be strongly elastically clamped in a space 28 between the adjacent comb-tooth-like portions 14, and in a space between the comb-tooth-like portion 14 and the male component 13, thereby improving the fastening force of the fastening member 10.

Furthermore, when a metal wire is used, the entire surface of the metal wire may be coated with, for example, a material in which acrylic beads with a diameter of 1 to 10 μm are contained by about 1.5 wt % in urethane paint, for the purpose of preventing a metallic allergy.

The spring comb 15 of the embodiment is formed by repeatedly folding one elastic wire in a plane, so that plural comb-tooth-like portions 14 are arranged in a flat shape. Each of the comb-tooth-like portions 14 is formed in such a way that a wire material is extended from the connection edge 18 toward the front end, and is folded back at the front end to return to the connection edge 18. The respective adjacent comb-tooth-like portions 14 are continuous through the connection edge 18.

When the spring comb 15 is formed by bending a wire, a longitudinal opening 14*e* is formed inside each comb-tooth-like portion 14, in addition to the space 28 between the adjacent comb-tooth-like portions 14. Thanks to this, as described below, when the spring comb 15 is slid, the respective comb-tooth-like portions 14 may be easily deformed, and therefore each comb-tooth-like portion 14 may be easily inserted into where the filament protrusions 12 and the hairs 19 are tangled. Further, when the head ornament is attached to the head, the hairs 19 may be easily tangled through the opening 14*e* or the space 28.

The shape of each comb-tooth-like portion 14 of the spring comb 15 is thinner at the front end and is thicker at the connection edge 18. The space 28 between the adjacent comb-tooth-like portions 14 is wider at the front end and is narrower at the connection edge 18. When such the shape is employed, as described below, the hairs 19 may be strongly clamped in the space 28 between the adjacent comb-tooth-like portions 14 when the spring comb 15 is slid to attach the head ornament.

Figure 5:
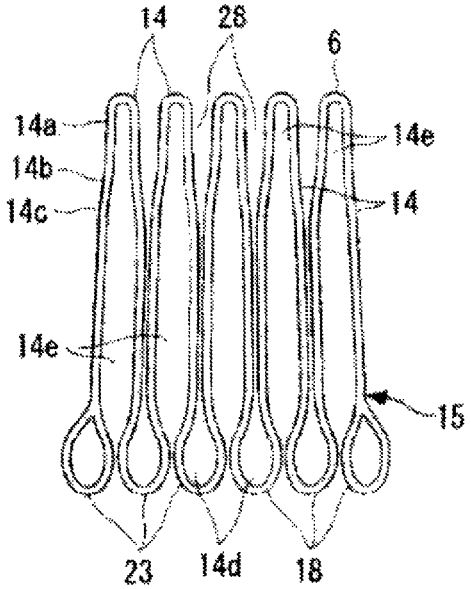
FIG. 5 is a plan view illustrating a spring comb according to an embodiment of the present invention.
Figure 6:
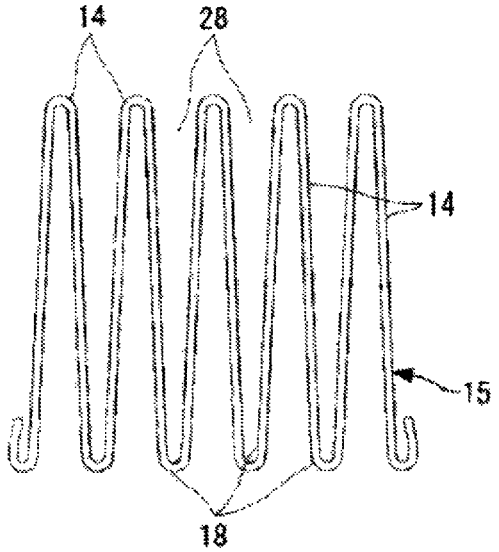
FIG. 6 is a plan view illustrating a spring comb according to another embodiment.

For example, as illustrated in FIG. 6, the shape of each comb-tooth-like portion 14 may be formed in such a way that the width gradually increases from the front end toward the connection edge 18. Furthermore, as illustrated in FIG. 5, a predetermined area at the front end of each comb-tooth-like portion 14 may be formed as a narrow portion 14*a* having a substantially constant width, and the remainder area may be formed as a wide portion 14*c* thicker than the narrow portion 14*a*, via a bent portion 14*b*. In this embodiment, the space 28 between the adjacent narrow portions 14*a* is wider, and the space 28 between the wide portions 14*c* is narrower.

The shape of the connection edge 18 of the spring comb 15 may also be appropriately selected. For example, it can have a simply U-shaped folded-back shape as illustrated in FIG. 6, and a loop portion 23 can be appropriately formed as illustrated in FIG. 5. The diameter of the loop portion 23 is larger than the space 28 between the comb-tooth-like portions 14. Thanks to this, the wire forming the comb-tooth-like portion 14 may be biased by the loop portion 23 so that the space between the spaces 28 is not widened. As a result, when the filament protrusion 12*s* or the hairs 19 are clamped between the respective comb-tooth-like portions 14, the force clamping the filament protrusions 12 or the hairs in the space 28 may be improved. In addition, when the loop portion 23 is formed, a user may grasp it to operate when attaching or detaching the head ornament fastening member 10, and thus the usability may be improved.

When a wire is used as the material of the spring comb 15, it is desirable that the thickness of the wire is 0.4 mm to 1.0 mm. It is more desirable that the thickness of the wire is 0.7 mm to 0.9 mm for ensuring the force of clamping the hairs 19.

The rigidity of the comb-tooth-like portion 14 is made at least harder than that of the hair 19, and is desirably made harder than that of the filament protrusion 12. Since the fastening member 10 is attached by laterally inserting the comb-tooth-like portion 14 into where the filament protrusions 12 are tangled with the hairs 19, the less rigidity of the comb-tooth-like portion 14 would make it difficult to insert the comb-tooth-like portion 14 because of the easy bendability. For example, when the bending rigidity of each comb-tooth-like portion 14 is set to a certain degree, with which the comb-tooth-like portion 14 is deformed under the load of 0.9 to 1.5 N, the comb-tooth-like portion 14 may be easily inserted between the hairs 19 and the comb-tooth-like portion 14 may be easily and appropriately deformed according to the shape of the head.

The length of each comb-tooth-like portion 14 from the connection edge 18 to the front end may be set to one, in which a part of the comb-tooth-like portion 14 crosses over the male component 13 beyond the peripheral edge of the male component 13, for example, 25 mm to 35 mm. When the length is too short, the fastening force decreases. On the other hand, when the length is too long, there may be a long portion, which is deeply inserted into the head ornament 20 and does not follow the shape of the head when the head ornament 20 is fixed to the hairs 19. Thus, the user may feel unpleasant.

The width of the front end of each comb-tooth-like portion 14 in the arrangement direction, that is, the width of the longitudinal opening 14*e* may be substantially equal to the width of the space 28 between the adjacent comb-tooth-like portions 14. It is desirable that the width is 0.5 to 2.0 mm, and the width of about 1.0 mm is particularly desirable. When the width is too wide, the hairs may easily escape from the space 28, so that the number of the reliably clamped hairs may decreases. When the width is too narrow, the hairs 19 may not be easily inserted into the space 28 between the comb-tooth-like portions 14, so that the number of the clamped hairs 19 extremely decreases and hence the fixing force decreases.

Figure 7:
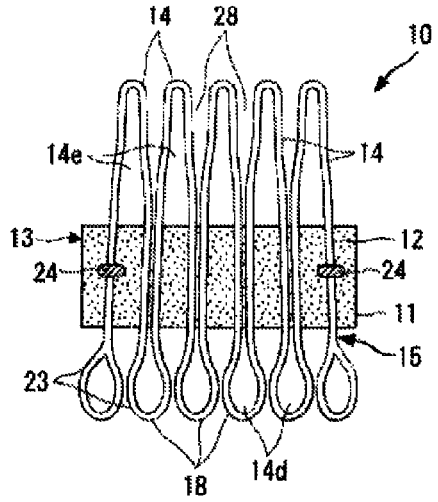
FIG. 7 is a plan view illustrating a state where the spring comb is slid, in the head ornament fastening member according to the embodiment of the present invention.

In the fastening member 10 of the embodiment, as illustrated in FIGS. 3 and 7, the male component 13 and the spring comb 15 are overlappingly connected to each other. The spring comb 15 is disposed on the surface area of the base sheet 11 having the filament protrusions 12, so as to intersect the filament protrusions 12.

In a state where the male component 13 and the spring comb 15 are connected to each other, the distance from the base sheet 11 to the comb-tooth-like portions 14 is preferably made smaller than the length of at least some of the filament protrusions 12. With such the distance, when the head ornament fastening member 10 is attached to the head, some of the filament protrusions 12 of the male component 13 penetrate the space 28 between the comb-tooth-like portions 14 of the spring comb 15, such that the relative movement of the head ornament fastening member 10 may be surely limited.

In this embodiment, a connection portion 24 which connects the spring comb 15 to the base sheet 11 is formed in an annular shape by fixing a filament thread or string of synthetic resin to the base sheet 11 of the male component 13. The wire material which forms the comb-tooth-like portion 14 of the spring comb 15 is loosely inserted into the connection portion 24, and therefore the spring comb 15 is slidable along the extension direction of the comb-tooth-like portions 14 relative to the male component 13.

Figure 8:
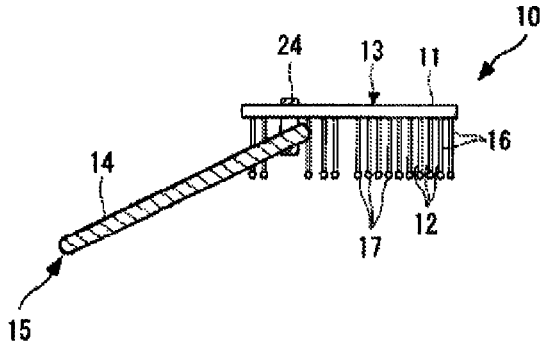
FIG. 8 is a cross-sectional view illustrating a state where the spring comb is inclined, in the head ornament fastening member according to the embodiment of the present invention.

In this embodiment, the connection portions 24 are fixed to the base sheet 11 at the same position in the extending direction of each comb-tooth-like portion 14, that is, a position on an imaginary line substantially perpendicular to the extension direction of the comb-tooth-like portion 14. One connection portion 24 may be preferably provided to one comb-tooth-like portion 14. Thanks to this, as illustrated in FIG. 8, when the spring comb 15 is slid such that the connection portion 24 is disposed near the connection edge 18 of the comb-tooth-like portion 14, the spring comb 15 can be inclined with respect to the base sheet 11, with the connection portion 24 being as a support point.

In this embodiment, only the comb-tooth-like portions 14 disposed at outer sides of the spring comb 15 are connected by the connection portions 24. Thanks to this, the sliding resistance generated when the spring comb 15 is slid relatively to the base sheet 11 made smaller, and thus the operability becomes satisfactory.

Next will be described how the head ornament 20 is attached to the hairs 19, using the fastening member 10 according to the embodiment.

First, as illustrated in FIG. 9, the fastening members 10 are attached to the rear side of the circumferential edge in the base 21 of the head ornament body 22 at plural positions with a distant from each other, such that the head ornament 20 is completed. Since the sufficient fixing force is obtained by the male component 13 and the spring comb 15, there is no need for providing the fastening members 10 over the entire circumference of the base 21. The number and the position of the fastening members 10 can be conveniently selected, and the respective fastening members 10 may be provided with an interval in between.

The fastening members 10 are attached to the base 21 in such a way that each comb-tooth-like portion 14 of the spring comb 15 is directed from the circumferential edge of the head ornament body 22 toward the inside of the head ornament body 22, that is, the comb-tooth-like portion 14 is slidable toward the inside of the head ornament body 22.

The fastening member 10 may be fixed to the base 21 in a manner such that, for example, a joint layer 27 such as an adhesive, a glue, and a double-face tape is provided on a surface of the base sheet 11 having no protrusion 12 by which the fastening member 10 is attached to the base 21, or the base sheet 11 is sewn to the base 21 for fixing the fastening member 10 to the base 21.

Subsequently, in order to attach the head ornament 20 to the head, the head ornament 20 is mounted onto the head and the filament protrusions 12 of the male component 13 are inserted into hairs 19 from upside, as illustrated in FIG. 10. The filament protrusions 12 are inserted between the hairs 19 by pressing a portion of the head ornament 20 corresponding to the male component 13 from the outside. At this time, the filament protrusions 12 may be tangled with the hairs 19.

With keeping to press that portion of the base 21 by a hand, the comb-tooth-like portions 14 of the spring comb 15 are slid from the side of the loop portion 23 toward the other end. Accordingly, the comb-tooth-like portions 14 are pressed into between the hairs 19 and the filament protrusions 12 in a lateral direction. Thus, the comb-tooth-like portions 14 of the spring comb 15 are inserted in at where the filament protrusions 12 of the male component 13 are tangled with the hairs 19.

When the spring comb 15 is slid, the inclination of each comb-tooth-like portion 14 with respect to the base sheet 11 is appropriately adjusted depending on the state of the remaining hairs, such that the angle of the inserted spring comb 15 is adjusted. Thanks to this, the stronger fastening force may be obtained depending on the state of the remaining hairs.

Figure 11:
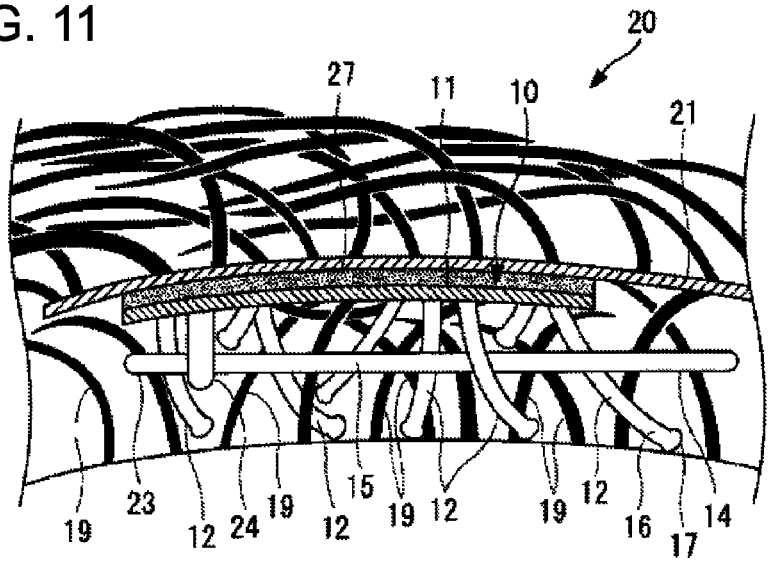
FIG. 11 is an enlarged cross-sectional view illustrating a state wherein the head ornament fastening member according to the embodiment of the present invention has been fixed to the hairs.

In this way, when the spring comb 15 is sufficiently slid while the comb-tooth-like portions 14 and the filament protrusions 12 are elastically deformed, the hairs 19 are clamped in the space 28 between the comb-tooth-like portions 14. The hairs 19 may be clamped between the comb-tooth-like portions 14 of the spring comb 15 and the male component 13. Further, the hairs 19 may be tangled into the space 28 inside the wire, which forms each comb-tooth-like portion 14. As illustrated in FIG. 11, fixing the fastening member 10 to the hairs 19, the attaching operation is completed.

In the fastening member 10 with the above-described construction, plural filament protrusions 12 of the male component 13 protrude from the base sheet 11. Thus, the plural filament protrusions 12 are inserted and engaged between the plural hairs 19, and tangled with the hairs 19, such that the fastening force may be obtained. In addition, the plural hairs 19 are clamped between the comb-tooth-like portions 14 of the spring comb 15, and the hairs 19 are engaged with the comb-tooth-like portions 14, such that the fastening force may be obtained.

In the fastening member 10, for attaching the head ornament 20 to the hairs 19, the male component 13 and the spring comb 15 intersect the hairs 19 in the longitudinal direction and the lateral direction, so that one filament protrusion 12 and one comb-tooth-like portion 14 intersect one hair 19, thereby improving the fastening force. Further, the filament protrusion 12 and the comb-tooth-like portion 14 can limit the movement of the other, such that the fastening force by the male component 13 and the spring comb 15 may be enhanced.

In addition, according to the invention, the head ornament 20 may be attached to the head in such a way that the filament protrusions 12 of the male component 13 are inserted into the hair 19 from the upside and the comb-tooth-like portions 14 of the spring comb 15 are inserted into that position in the lateral direction. Thanks to this, the attaching operation may be easily performed, because there is no need to apply a reversing force to a reversible member, which was needed for example in the prior art stopper.

On the other hand, when detaching the fastening member 10, the loop portions 23 of the spring comb 15 are pulled out toward the circumferential edge of the head ornament 20, contrary to when attaching for example, such that the fastening state of the comb-tooth-like portions 14 may be released. Since the head ornament 20 may be easily detached from the head in this way, the head ornament 20 may be easily attached and detached.

In particular, the spring comb 15 can be slid relatively to the base sheet 11, and therefore the comb-tooth-like portions 14 may be easily inserted into where plural filament protrusions 12 are tangled with the hairs 19. Thanks to this, the comb-tooth-like portions 14 may be disposed into where the filament protrusions 12 are tangled with the hairs 19, and therefore the fixing force is further enhanced.

According to the head ornament 20 of the invention in which the fastening member 10 is fixed to the base 21, the head ornament may be firmly attached to the hairs, with a sufficient fixing force to the hairs 19.

In the head ornament 20, the fastening members 10 are attached to the circumference of the head ornament body 22 at plural positions with a distance from each other, and there is no need for providing the fastening members 10 over the entire circumference of the head ornament body 22. Further, since the spring comb 15 is provided at the surface area of the filament protrusions 12 of the male component 13, it is possible to prevent the hairs of the head ornament from being tangled with the filament protrusions 12, which would happen if the male components 13 are densely arranged without any intervals in between. For this reason, the head ornament 20 may be easily handled.

In the head ornament 20, the plural comb-tooth-like portions 14 are connected to the base sheet 11 so as to be slidable inward in the lateral direction from the circumferential edge of the head ornament body 22. Thanks to this, the head ornament 20 may be attached to the hairs 19 without largely rolling up the circumferential edge of the head ornament body 22, so that the deterioration of the head ornament 20 is prevented and its durability is ensured.

The spring comb 15 is connected to the base sheet 11, such that the loop portion 23, which is located at the rear end in the slide direction of the plural comb-tooth-like portions 14, can be slid from a position outside the circumferential edge of the head ornament body 22 to a position inside the circumferential edge. Thanks to this, the head ornament 20 may be easily attached to the hairs, and the plural comb-tooth-like portions may be prevented from being recognized from the outside after attached, thereby obtaining a satisfactory appearance in use.

The above-described embodiments may be appropriately modified within the scope of the present invention. For example, the head ornament is not limited to a particular one, as long as it is what can be attached via the hairs 19.

In the above, there has been described an embodiment, where the male component 13 in the hook-and-loop fastener is employed, as a first fastening means. But, a member with plural stems would work like in the above-described embodiment.

In the above, there has been described an embodiment, where the spring comb is employed, as a second fastening means. But, there can be employed a member having plural linear materials arranged in parallel in a comb shape.

In the above, an embodiment of the head ornament 20, where the fastening member 10 is attached to the rear surface of the base 21 of the head ornament body 22 has been described. But, the male component 13 and/or the spring comb 15 can be directly attached to the head ornament 20.

EXAMPLES

Hereinafter, examples and comparative examples will be described.

The fixing forces were evaluated by using measurement samples of the examples 1-4 and the comparative examples 1-4.

Example 1

A spring comb 15 like the one shown in FIG. 5 having the comb-tooth-like portions 14 and the loop portions 23 was prepared. The spring comb 15 was formed of a metal wire, having a thickness of 0.85 mm. The spring comb 15 was formed, such that the number of the comb-tooth-like portions 14 was six, the width was 29 mm, and the length was 30 mm.

The male component 13 was formed in a rectangular shape with a width of 35 mm and a length of 15 mm, the filament protrusions 12 were arranged with the density of 80 filaments/$cm^2$, and the swollen portion 17 of 0.4 mm height was formed at the free end of each monofilament.

The spring comb 15 and the male component 13 were connected to each other, in such a way that both outer sides of the comb-tooth-like portions 14 of the spring comb 15 were respectively, at one position, sewn to the male component 13 with a monofilament thread of 0.16 mm thickness, such that the spring comb 15 was slidable. Thus, the fastening member 10 was completed.

Example 2

The thickness of the wire material of the spring comb 15 was 0.50 mm, the number of the comb-tooth-like portions 14 was seven, and the length was 25 mm. Other than these, the fastening member 10 was made in the same way as Example 1.

Example 3

The spring comb 15 was formed without the loop portion 23 as shown in FIG. 6, the thickness of the wire material was 0.80 mm, and the width was 30 mm. Other than these, the fastening member 10 was made in the same way as Example 1.

Example 4

The spring comb 15 and the male component 13 were connected to each other, in such a way that both outer sides of the comb-tooth-like portions 14 of the spring comb 15 are respectively, at two positions, sewn to the male component 13. Other than these, the fastening member 10 was made in the same way as Example 1.

Comparative Example 1

A fastening member constituted solely of the male component 13 in Examples 1-4 was made.

Comparative Example 2

A fastening member constituted solely of the spring comb 15 in Example 1 was manufactured.

Comparative Example 3

A fastening member constituted solely of the spring comb 15 in Example 2 was manufactured.

Comparative Example 4

A fastening member constituted solely of the spring comb 15 in Example 3 was manufactured.

Evaluation of Fixing Force

The fixing forces of the fastening members obtained in the Examples 1-4 and the Comparative Examples 1-4 were measured as below.

Figure 12:
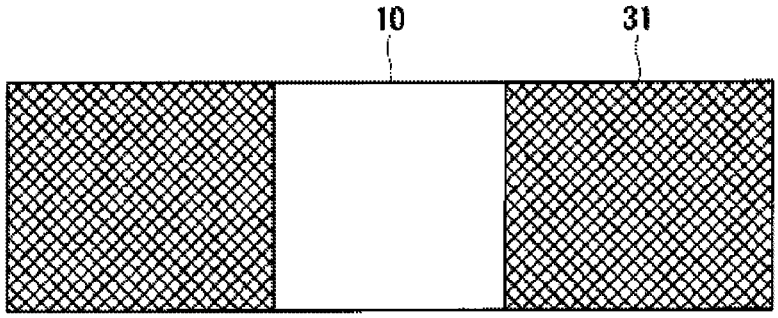
FIG. 12(*a*) is a view illustrating a state where a jig for measuring the samples of Examples 1-4 and Comparative Examples 1-4 is unfolded, and FIG. 12(*b*) is a side view illustrating the jig for measuring the samples of Examples 1-4 and Comparative Examples 1-4.
Figure 12:
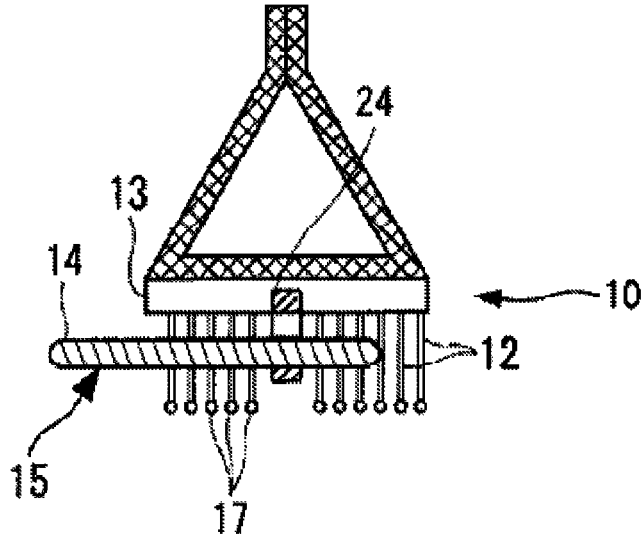

First, a measurement sample was made. The measurement sample was made in such a way that a fastening member 10 is sewed and fixed to the center position of a rectangular sheet 31 illustrated in FIG. 12(*a*). Both ends of the sheet 31 were folded at the portions where the fastening member was attached, and then both ends of the sheet 31 were adhered together as illustrated in FIG. 12(*b*) to complete the measurement sample.

The measurement sample was mounted onto a head and was fixed thereto according to the above-described manner. That is, in Examples 1-4, plural filament protrusions 12 of the male component 13 were inserted into the hairs 19 of a wig fixed to a head of a mannequin from upside, and the plural comb-tooth-like portions 14 of the spring comb 15 were inserted and fixed to the hairs 19 in lateral direction. In Comparative Examples 1-4, plural filament protrusions 12 or the comb-tooth-like portions 14 of the spring comb 15 were inserted and fixed to the hairs 19.

Figure 13:
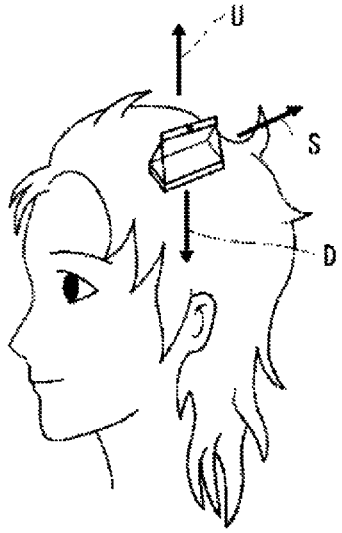
FIG. 13 is a perspective view explaining the measurement directions in Examples and Comparative Examples.

Subsequently, as illustrated in FIG. 13, loads required for a 5 cm movement were measured for each of the upward direction "U", the downward direction "D", and the lateral direction "S". The loads were measured by using a digital force gauge manufactured by Shimpo Corporation (trade name: DFG-1K).

The measurement results of the respective samples are illustrated in Table 1.

TABLE 1

| | Fixing force in upward direction (gf) | Fixing force in downward direction (gf) | Fixing force in lateral direction (gf) |
|---|---|---|---|
| Example 1 | 126 | 193 | 245 |
| Example 2 | 91 | 143 | 190 |
| Example 3 | 133 | 164 | 246 |
| Example 4 | 124 | 199 | 228 |
| Comparative Example 1 | 84 | 152 | 136 |
| Comparative Example 2 | 59 | 36 | 91 |
| Comparative Example 3 | 49 | 29 | 82 |
| Comparative Example 4 | 41 | 17 | 68 |

As shown in Table 1, in all Examples 1-4, the fixing force was sufficiently enhanced, compared with that of a sole male component 13 or a sole spring comb 15.

In particular, an extremely remarkable effect was found that the values of the fixing force of in some Examples were higher than a total value, which was obtained by adding the fixing force by a sole male component 13 and the fixing force by a sole spring comb 15. For example, the fixing force in the downward direction and the fixing force in the lateral direction in Examples 1 and 4 were respectively higher than the total value of that in Comparative Examples 1 and 2. The fixing force in the lateral direction in Example 3 was higher than the total value of that in Comparative Examples 1 and 4.

Regarding the spring comb 15, there is a tendency for the force of clamping the hairs 19 to become stronger as the wire material becomes thicker. Regarding the construction, there is a tendency that the tapered comb-tooth-like portions 14 and the loop portion 23 would make the force of clamping the hairs 19 stronger.

With respect to Example 4, when the male component 13 and the spring comb 15 are connected to each other at two positions, the fixing force in the lateral direction "S" decreases, although there is no difference in the fixing forces in the upward direction "U" and in the downward direction "D". This may be because the inserting angle of the spring comb 15 cannot be adjusted when attaching the fastening member 10 to the hairs 19. As a result, the hairs 19 are not clamped with an appropriate angle of the spring comb 15 depending on the remaining hairs on the head, and hence the fixing force may be reduced.

Example 5

Figure 14:
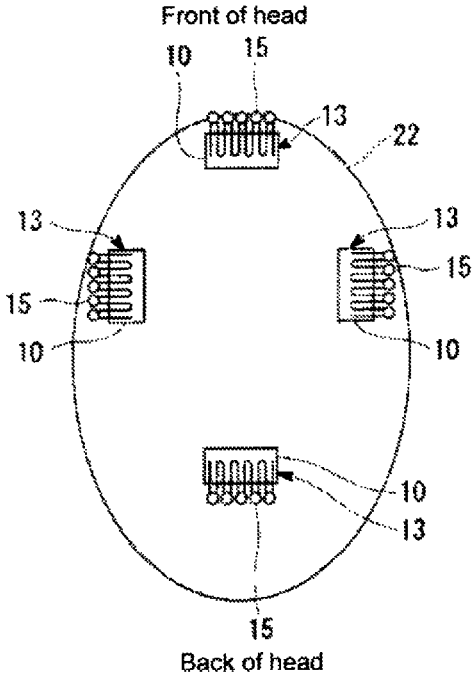
FIG. 14 is a schematic bottom view of a wig illustrating the positions of the head ornament fastening members on the wig, in Example 5, Comparative Example 5, and Comparative Example 6.

A wig of Example 5 was made by attaching the fastening members 10 having the male component 13 and the spring comb 15 in Example 1 to the rear surface of a head ornament body 22 at four positions in FIG. 14. In the wig, all front ends of the spring combs 15 are directed toward the center of the head ornament body 22.

Comparative Example 5

A wig of Comparative Example 5 was made in the same way as Example 5, except that a fastening member constituted solely of the male component 13 in Example 5 was used.

Comparative Example 6

A wig of Comparative Example 6 was made in the same way as Example 5, except that a fastening member constituted solely of the spring comb 15 in Example 5 was used.

Next, the wigs of Example 5 and Comparative Examples 5, 6 were attached to a head, and loads required for a 5 cm movement in each of the upward direction "U", the downward direction "D", and the lateral direction "S" were measured. The loads were measured by using a digital force gauge manufactured by Shimpo Corporation (trade name: FGPX-5).

The measurement results of the respective wigs are shown in Table 2.

TABLE 2

| | Fixing force in upward direction "U" (gf) | Fixing force in downward direction "D" (gf) | Fixing force in lateral direction "S" (gf) |
|---|---|---|---|
| Comparative Example 5 | 359 | 484 | 467 |
| Comparative Example 6 | 595 | 599 | 788 |
| Example 5 | 1147 | 1254 | 1637 |

As apparent from Table 2, in the wig of Example 5, the respective fixing forces in the upward direction, the downward direction, and the lateral direction are much higher than that in Comparative Example 5, which has the fastening member constituted solely of the male component 13, or that in Comparative Example 6, which has the fastening member constituted solely of the spring comb 15.

In general, where the fixing force generated by the fastening member is 1000 gf or more, it is recognized that a fairly strong fixing force is achieved. In Example 5, the fixing force is 1000 gf or more in all directions, and thus the fixing force sufficient for attaching the wig is obtained.

Further, the fixing forces in the upward direction, the downward direction, and the lateral direction of Example 5 are higher than the total value, which was obtained by adding the fixing forces of Comparative Example 5 having the fastening member constituted solely of the male component 13, and the fixing forces of Comparative Example 6 having the fastening member constituted solely of the spring comb 15. From this, it is apparent that a synergistic effect is obtained by the combination of the male component 13 and the spring comb 15.

It will be apparent to those skilled in the art that various modification and variations can be made in the present invention without departing from the spirit or scope of the invention. Thus, it is intended that the present invention cover modifications and variations that come within the scope of the appended claims and their equivalents.

The invention claimed is:

1. A head ornament fastening member that attaches a head ornament to hairs on a head, the head ornament fastening member comprising:

a first fastening means that includes a flexible base sheet, and a plurality of stems which protrude from a surface of the flexible base sheet in a direction generally perpendicular to the surface of the flexible base sheet so as to be insertable into the hairs from upside; and a second fastening means that includes a plurality of comb-tooth-like portions which intersect the plurality of stems so as to be insertable into the hairs from lateral direction, wherein the plurality of stems of the first fastening means and the plurality of comb-tooth-like portions of the second fastening means are configured to intersect to each other while being inserted into the hairs so as to be fastened to the hairs, thereby fastening the head ornament to the hairs.

2. The head ornament fastening member according to claim 1, wherein the second fastening means is connected to the flexible base sheet of the first fastening means so as to be slidable in the lateral direction, and hence the plurality of comb-tooth-like portions are slid and inserted into the hairs.

3. The head ornament fastening member according to claim 2, wherein the second fastening means is connected to the flexible base sheet of the first fastening means so as to be inclinable, and hence the plurality of comb-tooth-like portions can be inserted into the hairs while being inclined.

4. The head ornament fastening member according to claim 1, wherein the stems are formed of an elastic material, such that when the plurality of comb-tooth-like portions are slid, the stems are elastically deformed and inserted into the hairs.

5. The head ornament fastening member according to claim 4, wherein the rigidity of the stems ranges 1.5 to 4.0 times that of the hairs.

6. The head ornament fastening member according to claim 1, wherein each of the stems includes an elongated material protruding from the flexible base sheet of the first fastening means and a swollen portion swollen laterally from an axis of the elongated material, the swollen portion being able to be engaged with the hairs.

7. The head ornament fastening member according to claim 1, wherein the plurality of stems are formed to have irregular lengths, such that the positions of the plurality of stems in the hairs are irregular.

8. The head ornament fastening member according to claim 1, wherein the lengths of the stems range 3-6 mm.

9. The head ornament fastening member according to claim 1, wherein the density of the stems ranges 50-120 stems/$cm^2$.

10. The head ornament fastening member according to claim 1, wherein the comb-tooth-like portions are formed of an elastic material having a rigidity higher than that of the stems.

11. The head ornament fastening member according to claim 10, wherein each of the comb-tooth-like portions includes a longitudinal opening inside the comb-tooth-like portion, and hence each of the comb-tooth-like portions is deformed with the deformation of the longitudinal opening.

12. The head ornament fastening member according to claim 11, wherein in the second fastening means, spaces between the adjacent comb-tooth-like portions are wider at a front end, and are narrower at a rear end.

13. The head ornament fastening member according to claim 12, wherein the plurality of comb-tooth-like portions are formed by repeatedly folding one wire material in a plane, such that the adjacent comb-tooth-like portions are continuous to each other through a circular-arc loop portion, and the diameter of the circular-arc loop portion is larger than the space between the adjacent comb-tooth-like portions.

14. The head ornament fastening member according to claim 10, wherein the comb-tooth-like portions are loosely engaged with annular connection portions fixed to the flexible base sheet, so that the second fastening means is slidably connected to the flexible base sheet.

15. The head ornament fastening member according to claim 14, wherein in the second fastening means, the comb-tooth-like portions disposed at outer sides in a width direction are, respectively at one position, engaged with the annular connection portion.

16. The head ornament fastening member according to claim 1, wherein the flexible base sheet of the first fastening means is formed of a flexible material, and is deformable with the deformation of the head ornament.

17. A head ornament having a head ornament body which is to be attached to hairs on a head, the head ornament comprising:

a first fastening means that includes a flexible base sheet fixed to the head ornament body, and a plurality of stems protruding from a surface of the flexible base sheet in a direction generally perpendicular to the surface of the flexible base sheet so as to be insertable into the hairs from upside; and a second fastening means that includes a plurality of comb-tooth-like portions which intersect the plurality of stems and are inserted into the hairs from lateral direction, wherein the plurality of stems of the first fastening means and the plurality of comb-tooth-like portions of the second fastening means are configured to intersect to each other while being inserted into the hairs so as to be fastened to the hairs, thereby fastening the head ornament to the hairs.

18. The head ornament according to claim 17, wherein the first fastening means and the second fastening means are arranged at a plurality of separate positions at a circumferential edge of the head ornament body.

19. The head ornament according to claim 17, wherein the plurality of comb-tooth-like portions are connected to the flexible base sheet of the first fastening means so as to be slidable inward from the circumferential edge of the head ornament body.

20. The head ornament according to claim 19, wherein rear ends of the plurality of comb-tooth-like portions in the sliding direction are slidable from a position outside of the circumferential edge to a position inside the circumferential edge of the head ornament body.

* * * * *